United States Patent [19]

Sherman et al.

[11] Patent Number: 4,910,389

[45] Date of Patent: Mar. 20, 1990

[54] CONDUCTIVE POLYMER COMPOSITIONS

[75] Inventors: Edward S. Sherman, Sunnyvale; Mark S. Thompson, San Carlos; Andrew Tomlinson, Palo Alto, all of Calif.

[73] Assignee: Raychem Corporation, Menlo Park, Calif.

[21] Appl. No.: 202,762

[22] Filed: Jun. 3, 1988

[51] Int. Cl.[4] ..... H05B 3/10; H01B 1/06

[52] U.S. Cl. ..... 219/548; 219/504; 219/505; 219/549; 219/553; 252/503; 252/511

[58] Field of Search ..... 219/504, 505, 528, 548, 219/549, 552, 553; 338/22 R, 212, 214; 252/502, 503, 506, 508, 510, 511, 518

[56] References Cited

U.S. PATENT DOCUMENTS

| | | | |
|---|---|---|---|
| 4,107,092 | 8/1978 | Carnahan | 252/511 |
| 4,250,398 | 2/1981 | Ellis et al. | 219/345 |
| 4,277,673 | 7/1981 | Kelly | 219/528 |
| 4,304,987 | 12/1981 | Konynenburg | 219/553 |
| 4,545,926 | 10/1985 | Fouts, Jr. et al. | 252/511 |
| 4,731,199 | 3/1988 | Matsuo et al. | 252/511 |
| 4,732,701 | 3/1988 | Nishii et al. | 252/511 |

FOREIGN PATENT DOCUMENTS

| | | |
|---|---|---|
| 0038718 | 8/1986 | European Pat. Off. . |
| 0231068 | 5/1987 | European Pat. Off. . |
| 5159947 | 11/1974 | Japan . |
| 54-78745 | 6/1979 | Japan . |
| 61281153 | 6/1985 | Japan . |
| 1605005 | 12/1981 | United Kingdom . |

*Primary Examiner*—Teresa J. Walberg
*Assistant Examiner*—Leon K. Fuller
*Attorney, Agent, or Firm*—Marguerite E. Gerstner; Timothy H. P. Richardson; Herbert G. Burkard

[57] ABSTRACT

A conductive polymer composition which exhibits PTC behavior comprises a crystalline organic polymer, carbon black, and a high resistivity particulate filler. The high resistivity filler is semiconductive and has a resistivity at least 100 times that of the carbon black. Compositions of the invention exhibit good resistance stability when exposed to thermal cycling. They are useful in electrical devices requiring compositions with high resistivity.

30 Claims, 3 Drawing Sheets

CONDUCTIVE POLYMER COMPOSITIONS

BACKGROUND OF THE INVENTION

1. Field of the Invention

This invention relates to conductive polymer compositions and electrical devices comprising them.

2. Background of the Invention

Conductive polymers and electrical devices such as self-regulating heaters comprising them are well-known.

Reference may be made, for example, to U.S. Pat. Nos. 3,861,029, 4,177,376, 4,188,276, 4,237,441, 4,304,987, 4,388,607, 4,426,339, 4,514,620, 4,534,889, 4,545,926, 4,689,475, and 4,719,335, European Patent Publication No. 38,718 (Fouts, et al), and copending, commonly assigned application Ser. Nos. 711,909 filed Mar.14, 1985,(Deep, et al) now U.S. Pat. No. 4,761,541, 818,846 filed Jan. 14, 1985 (Barma) now abandoned, 75,929 filed July 21, 1987 (Barma, et al) and 202,165 Oswal, et al.) filed contemporaneously with this application, the disclosures of which are incorporated herein by reference. As a result of a PTC (positive temperature coefficient of resistance) anomaly, such compositions can be used in electrical devices to provide temperature control over a narrow temperature range, resulting in "automatic" shutdown in the event of exposure to overtemperature or overvoltage conditions or "automatic" heating when exposed to a colder environment.

Conductive polymer compositions can made in a wide range of resistivities in order to meet the requirements for a specific application. For example, compositions for circuit protection devices, which are normally powered at voltages of 10 to 600 volts, may have resistivities of 0.001 to 100 ohm-cm. Strip heaters designed to be powered at 120 to 240 volts have routinely been made from compositions with resistivities of 1,000 to 50,000 ohm-cm. Laminar resistance heaters which may have a small distance between the electrodes and thus a short current path may require compositions with resistivities of 500 to 500,000 ohm-cm. Using traditional conductive fillers such as carbon black, it is difficult to make high resistivity conductive polymer compositions, i.e. those with a resistivity of more than 10,000 ohm-cm, reproducibly. FIG. 1 shows a loading curve for a conductive polymer: the resistivity on a log scale is plotted as a function of the percent by volume of filler. For a filler of a given resistivity, the polymer is relatively nonconductive until a threshold filler loading is reached (region A). In region B, the resistivity decreases rapidly as the filler concentration increases. The sensitivity of the resistivity to filler loading is relatively low in region C. For conductive polymer compositions which have high resistivities and a low concentration of filler, small errors during the weighing of the ingredients or inconsistencies during mixing will have a significant effect on the resistivity of the final composition.

A second issue for conductive polymer compositions is that of thermal stability. During the normal operation of devices comprising conductive polymers it is common for the polymer to be exposed to a variety of thermal conditions, either as a result of the device self-heating or due to changes in the ambient temperature. In the case of heaters, it is common for the PTC element comprising the conductive polymer to undergo a large number of thermal cycles from low temperature to elevated temperatures. These elevated temperatures may be equal to or greater than the melting point, Tm, of the polymer matrix in the conductive polymer. (Tm is defined as the temperature at the peak of the melting curve of the conductive polymer as measured by a differential scanning calorimeter.) Although it is common for the polymer to undergo changes in resistivity as a result of oxidation or relaxation when exposed to elevated temperatures, for cost applications these resistivity changes are not desirable. For instance, heaters are expected to produce a specific power output at a given voltage. As the resistance increases, the power will decrease. It is particularly undesirable for the resistance to change each time the heater is exposed to an elevated temperature. Alternatively, circuit protection devices must be stable so that the switching current is not adversely affected.

A number of proposals for producing high resistivity compositions and/or increasing the thermal and electrical stability of conductive polymer compositions have been made. In several cases, conductive fillers which have a higher resistivity than conventional conductive fillers have been used. If a greater quantity (i.e. higher loading) of filler is required to generate a comparable resistivity, the sensitivity of the loading curve can be minimized.

U.S. application Ser. Nos. 818,846 filed Jan. 14, 1985 (Barma) and 75,929 filed July 21, 1987 (Barma now abandoned, et al.) disclose conductive polymer compositions in which the particulate conductive filler distributed in the polymer matrix itself comprises a conductive polymer in which a second particulate filler is distributed in a polymer matrix.

Japanese Patent Application No. 49-134096 (published as No. 51-59947) discloses conductive compositions comprising a crystalline organic polymer having dispersed therein conductive particles which have a resistivity of less than 1 ohm-cm (e.g. carbon black or silver) and 1 to 20% by volume of inorganic particles (e.g. zinc oxide, cadmium sulfide, or silicon, or other meal oxides). These compositions are suitable for use in photometers, thermistors, and magnetometers. Japanese Patent Application No. 54-78745 discloses a PTC composition which comprises a polymer matrix having dispersed therein conductive particles (e.g. graphite or carbon black) and semiconductive particles (e.g. a metal oxide or organic semiconductor such as TCNQ) in a volume ratio of 0.25:4.0. None of these publications defines the specific particle sizes and ratios of the fillers necessary to provide thermal stability in a PTC conductive polymer composition.

European Patent Publication No. 38,718 discloses the use of non-conductive particulate fillers, i.e. those with a resistivity greater than $1\times10^6$, to improve the thermal stability of conductive compositions comprising carbon black. In preferred formulations the volume loading of the non-conductive filler is less than that of the carbon black.

U.S. Pat. No. 4,545,926 discloses conductive polymer compositions in which the electrical stability, as measured by current transients, is improved by the addition of a nonmetallic filler to a polymer/metal blend.

SUMMARY OF THE INVENTION

We have now found that conductive polymer compositions that exhibit high resistivity, good thermal stability, and PTC behavior can be made by blending an organic polymer with carbon black and a semiconductive particulate filler of a specified resistivity. Therefore, one aspect of the invention discloses a PTC composition which comprises (1) a crystalline organic polymer which has a melting point $T_m$;

(2) a first particulate conductive filler which (i) comprises carbon black, (ii) has a particle size $D_1$, and (iii) is present at a volume loading $V_1$; and (3) a second particulate filler which (i) is semiconductive, (ii) has a particle size $D_2$, and (iii) is present at a volume loading $V_2$, wherein (a) the resistivity of the second filler $p_2$ is at least 100 times the resistivity of the first filler $p_1$, and (b) the resistivity of the composition is at least 100 ohm-cm.

In another aspect, the invention discloses an electrical device which comprises (1) a PTC element which is composed of a conductive polymer composition as defined in the first aspect of the invention; and (2) at least two electrodes which can be connected to a source of electrical power to cause current to flow through the PTC element.

DETAILED DESCRIPTION OF THE INVENTION

Figure 1:
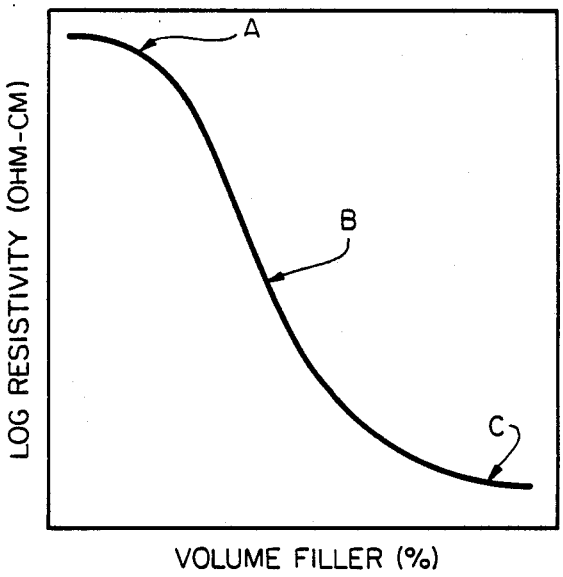
FIG. 1 is a graph of resistivity a function of the volume percent filler loading plotted on a semilogarithmic scale.

The conductive polymer compositions of this invention exhibit PTC behavior. The terms "PTC anomaly" and "composition exhibiting PTC behavior" are used in this specification to denote a composition which has an $R_{14}$ value of at least 2.5 or an $R_{100}$ value of at least 10, and preferably both, and particularly one which has an $R_{30}$ value of at least 6, where $R_{14}$ is the ratio of the resistivities at the end and the beginning of a 14° C. range, $R_{100}$ is ratio of the resistivities at the end and the beginning of a 100° C. range, and $R_{30}$ is the ratio of the resistivities at the end and the beginning of a 30° C. range.

The conductive polymer composition comprises an organic polymer (such term being used to include siloxanes), preferably a crystalline organic polymer. Suitable crystalline polymers include polymers of one or more olefins, particularly polyethylene; copolymers of at least one olefin and at least one monomer copolymerisable therewith such as ethylene/acrylic acid, ethylene/ethyl acrylate, and ethylene/vinyl acetate copolymers; melt-shapeable fluoropolymers such as polyvinylidene fluoride and ethylene/tetrafluoroethylene copolymers; and blends of two or more such polymers. For some applications it may be desirable to blend one crystalline polymer with another polymer in order to achieve specific physical or thermal properties, e.g. flexibility or maximum exposure temperature. Other polymers which may be used include amorphous thermoplastic polymers such as polycarbonate or polystyrene and elastomers such as polybutadiene or ethylene/propylene/diene (EPDM) polymer. For some freeze-protection applications, it may be preferred to use a crystalline organic polymer comprising a polyalkenamer such as those disclosed in U.S. Pat. No. 4,14,620 (Cheng, et al.).

When the polymeric component is a crystalline organic polymer, it is preferred that the crystallinity be at least 5%, preferably at least 10%, particularly at least 15%, especially at least 20%.

The first particulate conductive filler comprises carbon black. Particularly suitable carbon blacks are those which have a particle size ($D_1$) of 20 to 250 millimicrons and a surface area (S) such that the ratio $S/D_l$ is not more than 10. Particularly preferred are carbon blacks which have a particle size in the range of 30 to 60 millmicrons, especially 40 to 50 millimicrons. For some compositions in which zinc oxide comprises the second particulate filler, carbon blacks with an ASTM designation of N660 are particularly preferred. The resistivity of the first particulate filler is designated $p_1$.

The second particulate conductive filler comprises a material which is semiconductive, i.e. a material which is capable of conducting electricity under certain specified conditions such as exposure to light of a particular wavelength or under certain thermal conditions. In addition, the second filler has a high volume resistivity. In this specification, the term "high volume resistivity" indicates a particulate material which, when compressed under specified conditions, has a resistivity at least 100 times greater than the resistivity of the first particulate filler measured under the same conditions. In some preferred formulations, the resistivity of the second filler is at least 1000 times, particularly at least 10,000 times the resistivity of the first filler. The resistivity of the second filler, $p_2$, is $10^{-1}$ to $10^8$ ohm-cm, preferably 1 to $10^6$ ohm-cm, particularly 10 to $10^5$ ohm-cm. Examples of fillers which exhibit both high resistivity and semiconductivity are ZnO, $Fe_2O_3$, $Fe_3O_4$, ZnS, CdS, PbS, SiC, $V_2O_3$, FeO, $NbO_2$, $MnO_2$, $SnO_2$, $In_2O_3$, $MoS_2$, $WS_2$, and NiO. The second filler may be a single material or it may comprise a blend of particulate fillers. The particulate filler may be doped with another, material in order to modify conductivity or another property or it may be coated with another material. For example, a nonconductive filler may be coated with a semiconductive material (e.g. an antimony-doped tin oxide coating on titanium dioxide).

Another advantage of many of these materials is that they exhibit NTC (negative temperature coefficient of resistance) behavior, i.e. they decrease in resistivity as the temperature increases. Preferred materials are those which decrease in resistivity at a constant rate by less than 50 times in the temperature range from 0° to 100° C. When incorporated into the polymer matrix, these NTC fillers may result in the conductive polymer composition exhibiting NTC behavior at temperatures below $T_m$. In some compositions the NTC behavior may not be significant but may serve to compensate for a gradual PTC anomaly, making the R(T) curve more square, i.e. a flatter slope below the switching temperature $T_s$. ($T_s$ is defined as the temperature at the intersection point of extensions of the substantially straight portions of a plot of the log of the resistance of a PTC element against temperature which lie on either side of the portion showing the sharp change in slope.) This flatter slope (which may include a slight NTC anomaly) is advantageous in reducing the inrush current, i.e. the current hat is observed immediately after powering the device and before the heater reaches an equilibrium state. If the resistance at ambient temperature is less than the resistance at $T_s$, the device will draw a higher current at ambient, i.e. Immediately after powering, than at $T_s$. The electric circuitry, e.g. circuit breakers, associated with the device must be selected to accommodate the high inrush current. If an NTC filler is used, the ratio between the equilibrium and the initial current is minimized.

Compositions which exhibit the best thermal stability (as defined by the stability ratio described hereinafter) are those in which the volume loading (defined as the percent by volume of the total composition) of the second filler, $V_2$, is greater than that of the first filler, $V_1$. Although the total filler loading by volume $V_t$ (the sum of $V_1$ and $V_2$) is dependent on the application and the desired resistivity, preferred compositions have a total filler loading of 20 to 50%, preferably 25 to 45%, particularly 30 to 40%. For these compositions, the ratio of $V_1$ to $V_2$ is 20:80 to 40:60, preferably 25:75 to 35:65.

It is believed that enhanced stability is due to efficient packing of the filler particles in the polymer matrix resulting in improved particle to particle and particle to polymer interaction. It has been found that if the ratio of the particle size of the first filler $D_1$ to the particle size of the second filler $D_2$ is 1:5 to 1:20, preferably 1:7 to 1:15, stable compositions are achieved. (Particle size is used in this specification to mean the average diameter of a spherical particle or the average distance of the longest dimension of a non-spherical particle in which the "particle" is an individual element or grain, not an aggregate or agglomerate.) In order to meet this criterion when the preferred carbon blacks are used, the particle size of the second filler is 0.2 to 1.0 micron, preferably 0.3 to 0.9 micron, particularly 0.35 to 0.8.

A preferred material for use as a second particulate filler is zinc oxide (ZnO). Small-particle size ZnO (e.g. less than 0.2 microns) has been commonly used in conductive polymers as a reinforcing filler or acid scavenger, but normal loadings have been in the range of 5 to 10% by volume of the carbon black loading. In the preferred compositions of this invention, the ZnO is present as the dominant filler by volume. ZnO is available in particle sizes from less than 0.2 microns to more than 1.0 microns and is semiconductive. An "unooped" material with a particle size of about 0.6 microns has a resistivity of approximately $1\times10^8$ ohm-cm when measured at 2000 pounds force in a 0.75 inch diameter cylinder. When the ZnO is doped with aluminum, the resistivity will be approximately 100 ohm-cm. The choice of which type of ZnO to use is dependent on the application.

The second particulate filler may be surface-treated, e.g. oxidized or coated, in order to change the properties of the final composition or to improve the dispersion during mixing. Particularly preferred are materials which tend to enhance the particle to polymer interaction and/or bonding. Such materials may be coupling or dispersing agents. A preferred coating for ZnO is propionic acid. The coating may be applied to the particulate filler prior to mixing with the polymer or it may be added as a separate ingredient to the mixture. Other suitable materials are disclosed in U.S. application Ser. No. 711,909 filed Mar. 14, 1985 (Deep, et al.) now U.S. Pat. No. 4,774,024, the disclosure of which is incorporated herein by reference.

Compositions of the invention have a resistivity of at least 100 ohm-cm, preferably at least 1000 ohm-cm, particularly at least 10,000 ohm-cm, especially at least 50,000 ohm-cm, e.g. 50,000 to 1,000,000 ohm-cm. High resistivities (i.e. greater than 10,000 ohm-cm) are preferred when the composition is used in a laminar heater. In addition to the polymer, and the first and second particulate conductive fillers, the composition may also comprise inert fillers, antioxidants, flame retardants, prorads, stabilizers, dispersing agents, or other components. Mixing may be conducted by any suitable method, e.g. melt-processing, sintering, or solvent-blending.

The conductive polymer composition may be crosslinked by irradiation or chemical means. Although the particular level of crosslinking is dependent on the polymeric components and the application, normal crosslinking levels are equivalent to that achieved by an irradiation dose in the range of 2 to 50 Mrads, preferably 3 to 30 Mrads, e.g. 10 Mrads.

The conductive polymer composition of the invention may be used in a PTC element as part of an electrical device, e.g. a heater, a sensor, or a circuit protection device. The resistivity of the composition is dependent on the dimensions of the PTC element and the power source to be used. For circuit protection devices which may be powered from 15 to 600 volts, the conductive polymer composition preferably has a resistivity of 0.01 to 100 ohm-cm. For electrical devices suitable for use as heaters powered at 6 to 60 volts DC, the resistivity of the composition is preferably 10 to 1000 ohm-cm; when powered at 110 to 240 volts AC, the resistivity is preferably about 1000 to 10,000 ohm-cm. Higher resistivities are suitable for devices powered at voltages greater than 240 volts AC.

The PTC element ay be of any shape depending on the application. Circuit protection devices and laminar heaters frequently comprise laminar PTC elements, while strip heaters may be rectangular, elliptical, or dumbell- ("dogbone-") shaped. Appropriate electrodes, suitable for connection to a source of electrical power, are selected depending on the shape of the PTC element. Electrodes may comprise metal wires or braid, e.g. for attachment to or embedment into the PTC element, or they may comprise metal sheet, metal mesh, conductive (e.g. metal- or carbon-filled) paint, or any other suitable material. For improved adhesion, the electrodes may be preheated during attachment to the PTC element or they may be coated with a conductive adhesive layer.

Laminar heaters in which the current flows in a direction normal to the surface of the PTC element are particularly useful with compositions of the invention. The electrodes used with these heaters are frequently metal mesh or perforated metal sheet, or preferably metal sheets, particularly electrodeposited copper or nickel as disclosed in U.S. Pat. No. 4,689,475 (Mathiesen), the disclosure of which is incorporated herein by reference. Heaters of this type normally have an electrode separation of 0.010 to 0.100 inch, preferably 0.020 to 0.080 inch, particularly 0.030 to 0.060 inch.

The PTC element may be covered with a dielectric layer for electrical insulation and environmental protection.

Compositions of this invention are stable when exposed to thermal cycling. The stability is measured by cycling samples comprising the material from a temperature which is at least 20° C. below the melting point of the polymer, commonly 20° to −40° C., to a temperature which is above, preferably at least 20° C. above the melting point of the polymer and then back to the initial temperature. The cycle is run at least 2 times, preferably at least 4 times, e.g. 10 times. The stability ratio is calculated by dividing the resistance at the initial temperature on the final cycle by the resistance at the initial temperature on the first cycle or by dividing the resistance at the initial temperature on any of cycle 2 to the final cycle by the resistance at the initial temperature of the first cycle, whichever ratio is higher.

Compositions which are perfectly stable have a ratio of 1.0. Compositions of this invention have a ratio of 0.5 to 3.0, preferably 0.6 to 2.0, particularly 0.8 to 1.5. The ratios less than 1.0 indicate a resistance decrease in the polymeric composition, possibly due to relaxation of mechanically-induced stresses.

FIG. 1 is a schematic representation of a loading curve in which the log of the resistivity is plotted as a function of the volume percent of conductive filler in the composition. At low loadings, the resistivity is very high (region A). Once a threshold concentration is reached, the resistivity decreases rapidly with increasing filler loading (region B). At relatively high filler concentrations (region C), the resistivity is relatively insensitive to changes in loading.

Figure 2A:
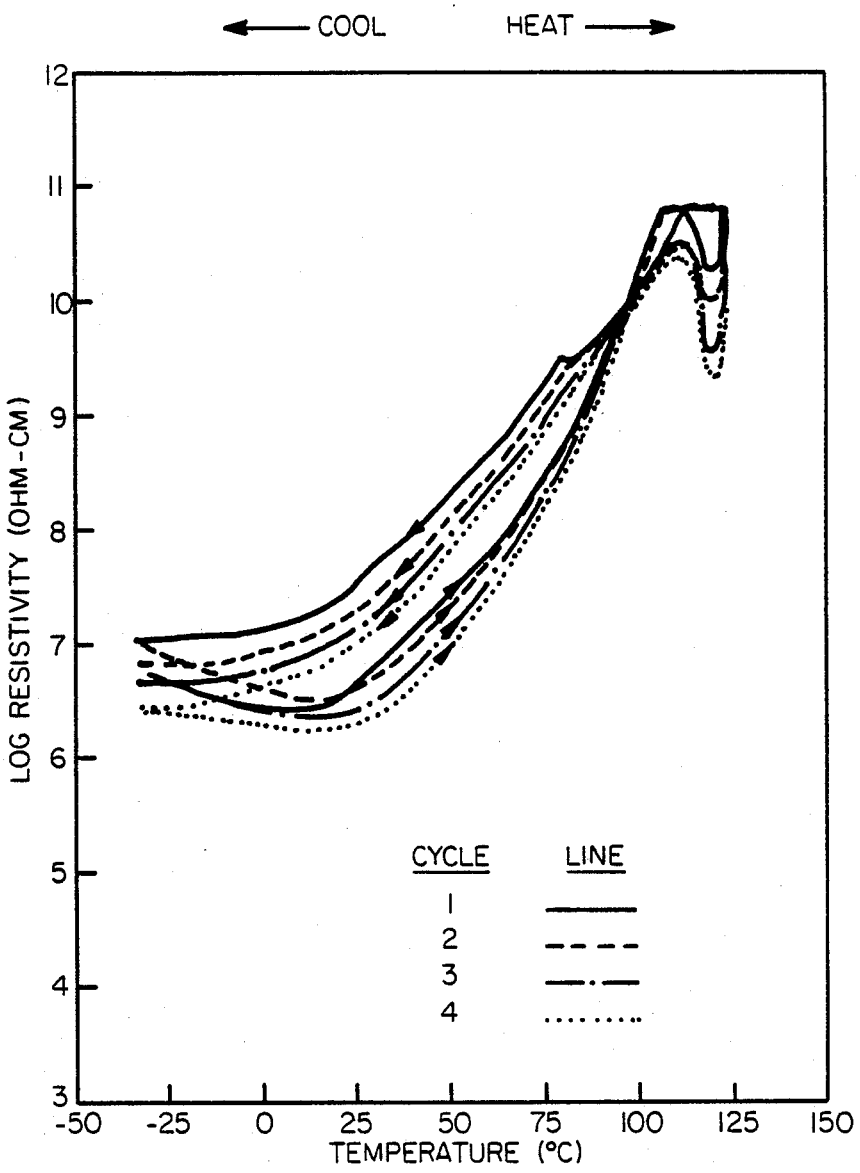
FIGS. 2A and 2B show resistivity vs. temperature curves for two conductive polymer compositions.
Figure 2B:
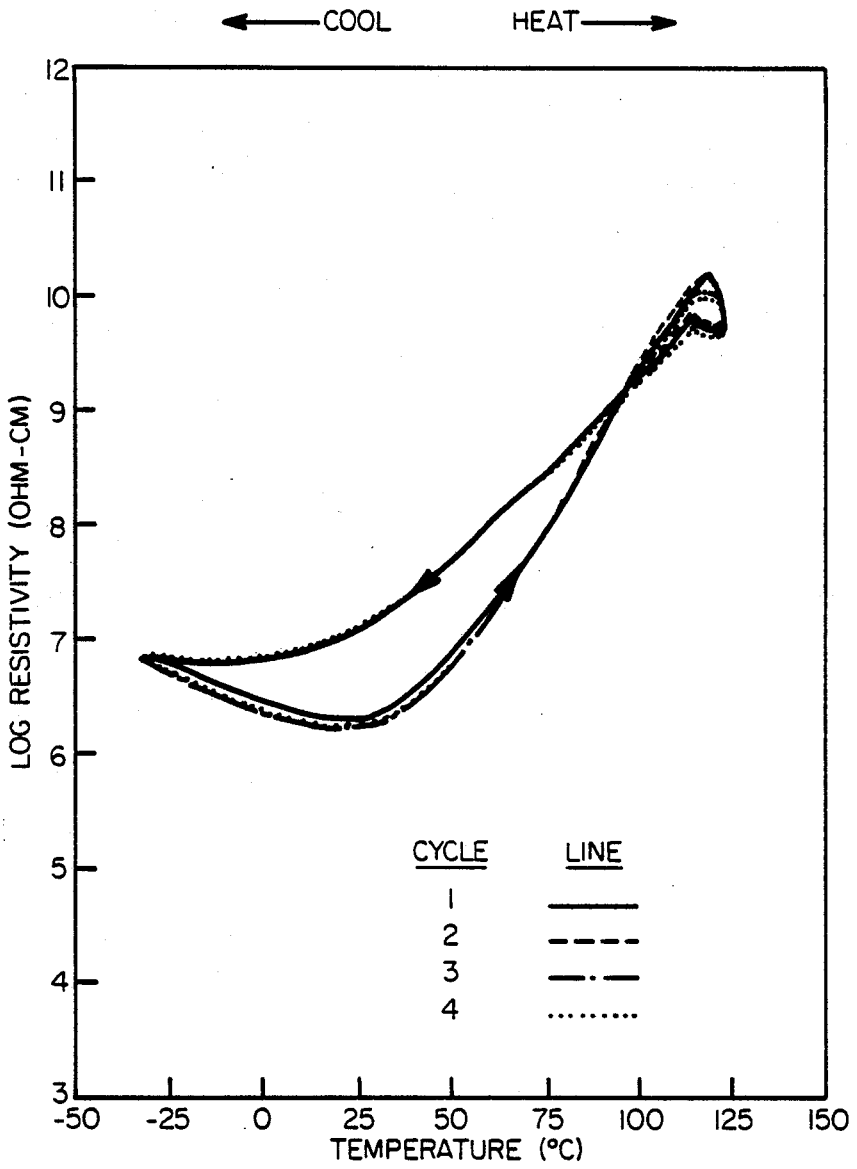

FIGS. 2A and 2B show the resistivity vs. temperature characteristics (i.e. R(T) curves) for two conductive formulations. The results of four thermal cycles from −30° to 125° C. are presented; the arrows indicate the direction of the temperature cycle as either heating or cooling. FIG. 2A shows a composition which is not thermally stable. FIG. 2B shows a composition which has good thermal stability. Both compositions show NTC character in the temperature range between −30° and 25° C.

Figure 3:
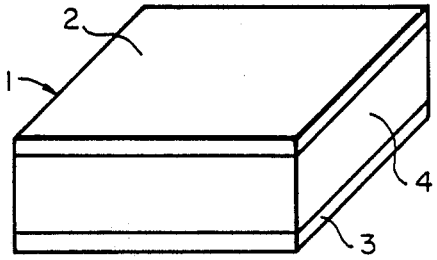
FIG. 3 is an electrical device made in accordance with the invention.

FIG. 3 shows a laminar heater which-comprises metal electrodes 2,3 attached to opposite sides of a laminar PTC element 4 which comprises a conductive polymer composition.

The invention is illustrated by the following examples.

EXAMPLES 1-9

The compositions listed in Table I were prepared in a Brabender mixer by adding the carbon black, zinc oxide, and antioxidant to the melted polymer and then mixing for 8 minutes at 170° C. The conductive compositions were compression-molded into 0.030 inch thick (0.076 cm) plaques which were then laminated with 0.0018 inch (0.0045 cm) electrodeposited copper electrodes. Samples were cut from each plaque. R(T) curves were generated by measuring the resistance as a function of temperature over a temperature range from 20° C. to 20 degrees above the melting temperature of the highest melting polymeric component and back to 20 degrees. A stability ratio was calculated by dividing the resistivity at 20° C. at the completion of the fourth thermal cycle by the initial resistivity at 20° C.

The results indicate that those compositions which comprise a large particle size ZnO (Example 5) or a small particle size ZnO (Example 4) have significant instability. The most stable material is that which comprises ZnO with a particle size of 0.6 that has been coated with propionic acid (Example 1). The formulations without carbon black (Examples 6 and 7) exhibited instability.

The resistivities listed in Table I were calculated from resistances measure at an electric field of less than 20 V/cm.

TABLE I

| Example: | 1 | 2 | 3 | 4 | 5 | 6 | 7 | 8 | 9 |
|---|---|---|---|---|---|---|---|---|---|
| Component (volume %): | | | | | | | | | |
| LLDPE | 39 | 36 | 39 | 39 | 39 | | 37.8 | | |
| HDPE | | | | | | 60 | | 60 | 65 |
| EEA | 25 | | 25 | 25 | 25 | | 25.2 | | |
| EEMA | | 24 | | | | | | | |
| CB I | 10.5 | 8 | 10.5 | 10.5 | 10.5 | | | | |
| CB II | | | | | | | | 8 | 14 |
| ZnO I (0.6)* | 25 | | | | | | | | |
| ZnO II (0.5)* | | 32 | | | | 40 | 37 | 32 | 21 |
| ZnO III (0.6)* | | | 25 | | | | | | |
| ZnO IV (0.37)* | | | | 25 | | | | | |
| ZnO V (0.8)* | | | | | 25 | | | | |
| AO | 0.5 | | 0.5 | 0.5 | 0.5 | | | | |
| Resistivity (ohm-cm) | $2 \times 10^6$ | $2.4 \times 10^4$ | $3.7 \times 10^6$ | $2.7 \times 10^9$ | $1.5 \times 10^4$ | $2 \times 10^3$ | $8 \times 10^3$ | $7 \times 10^3$ | $3 \times 10^1$ |
| Stability ratio | 0.87 | 0.56 | 0.56 | 3.2 | 10 | 4.6 | 0.33 | 1.5 | 1.2 |

*Indicates the particle size of the zinc oxide filler in microns.

Notes to Table I:

LLDPE is DFDA 7547, a linear low density polyethylene available from Union Carbide.

HDPE is Marlex 6003, a high density polyethylene available from Phillips Petroleum.

EEA is DPD 6169, an ethylene/ethyl acrylate copolymer available from Union Carbide.

EEMA is Gulf 2205, an ethylene/ethylmethacrylate copolymer available from Gulf Chemical Company.

CB I is Statex G, a furnace carbon black with a particle size of 50 millimicrons, a nitrogen surface area of 36 $m^2/g$, and an oil absorption (DBP) number of 90, available from Columbian Chemicals.

CB II is Denka Black, an acetylene carbon black with a particle size of 40 millimicrons, a nitrogen surface area of 70 $m^2/g$, and an oil absorption (DBP) number of 250, available from Denki Kagaku Kogyo K.K.

ZnO I is XX-631, a zinc oxide with a particle size of 0.6 microns which has been treated with 0.1% propionic acid, available from New Jersey Zinc Company.

ZnO II is HC-238, an aluminum-doped zinc oxide with a particle

TABLE I-continued size of 0.5 microns, available from New Jersey Zinc Company.
ZnO III is XX-600, a zinc oxide with a particle size of 0.6 microns, available from New Jersey Zinc Company.
ZnO IV is XX-85, a doped zinc oxide with a particle size of 0.37 microns, available from New Jersey Zinc Company.
ZnO V is XX-503, a zinc oxide with a particle size of 0.8 microns, available from New Jersey Zinc Company.

What is claimed is:

1. A conductive polymer composition which exhibits stable PTC behavior and which comprises (1) a crystalline organic polymer which has a melting point $T_m$;

(2) a first particulate conductive filler which (i) comprises carbon black, (ii) has a particle size $D_1$, and (iii) is present at a volume loading $V_1$; and (3) a second particulate filler which (i) is semiconductive, (ii) has a particle size $D_2$, and (iii) is present at a volume loading $V_2$, wherein (a) the resistivity of the second filler $p_2$ is at least 100 times the resistivity of the first filler $p_1$, and (b) the resistivity of the composition is at least 100 ohm-cm.

2. A composition according to claim 1 wherein $p_2$ is $10^{-1}$ to $10^8$ ohm-cm.

3. A composition according to claim 2 wherein $p_2$ is 1 to $10^6$ ohm-cm.

4. A composition according to claim 3 wherein $p_2$ is 10 to $10^5$ ohm-cm.

5. A composition according to claim 1 wherein the resistivity of the composition is at leas 1000 ohm-cm.

6. A composition according to claim 5 wherein the resistivity of the composition is at least 10,000 ohm-cm.

7. A composition according to claim 1 wherein $D_2$ is 0.2 to 1.0 micron.

8. A composition according to claim 7 wherein $D_2$ is 0.3 to 0.9 micron.

9. A composition according to claim 8 wherein $D_2$ is 0.35 to 0.8 micron.

10. A composition according to claim 1 wherein the ratio $D_2$ to $D_1$ is 1:5 to 1:20.

11. A composition according to claim 10 wherein the ratio $D_2$ to $D_1$ is 1:7 to 1:15.

12. A composition according to claim 1 wherein $p_2$ is at least 1000 times $p_l$.

13. A composition according to claim 1 wherein the total loading by volume of the first and second fillers $V_t$ is 20 to 50%.

14. A composition according to claim 13 wherein $V_t$ is 25 to 45%.

15. A composition according to claim 14 wherein $V_t$ is 30 to 40%.

16. A composition according to claim 13 wherein the ratio of $V_1$ to $V_2$ is 20:80 to 40:60.

17. A composition according to claim 16 wherein the ratio of $V_1$ to $V_2$ is 25:75 to 35:65.

18. A composition according to claim 1 wherein the carbon black has a particle size $D_1$ from 30 to 60 millimicrons.

19. A composition according to claim 1 wherein the second filler is zinc oxide.

20. A composition according to claim 19 wherein the zinc oxide is doped with aluminum.

21. A composition according to claim 1 wherein the second filler has been surface treated.

22. A composition according to claim 21 wherein the surface treatment is a coating of a dispersing agent.

23. A composition according to claim 22 wherein the dispersing agent is propionic acid.

24. A composition according to claim 1 wherein the second filler exhibits NTC behavior.

25. An electrical device which exhibits PTC behavior and which comprises (1) a PTC element comprising a conductive polymer composition which exhibits PTC behavior and which comprises (a) a crystalline organic polymer which has a melting point $T_m$;

(b) a first particulate conductive filler which (i) comprises carbon black, (ii) has a particle size $D_1$, and (iii) is present at a volume loading $V_1$; and (c) a second particulate filler which (i) is semiconductive, (ii) has a particle size $D_2$, and (iii) is present at a volume loading $V_2$, wherein (A) the resistivity of the second filler $p_2$ is at least 100 times the resistivity of the first filler $p_1$, and (B) the resistivity of the composition is at least 100 ohm-cm, and (2) at least two electrodes which can be connected to a source of electrical power to cause current to flow through the PTC element.

26. A device according to claim 25 wherein the electrical device is a self-regulating heater.

27. A device according to claim 26 wherein the PTC element is laminar.

28. A device according to claim 27 wherein the electrodes comprise laminar metal sheets.

29. A device according to claim 28 wherein the electrodes comprise electrodeposited metal.

30. A device according to claim 25 wherein the electrical device is crosslinked to a level equivalent to an irradiation dose of 2 to 40 Mrad.

* * * * *

UNITED STATES PATENT AND TRADEMARK OFFICE

CERTIFICATE OF CORRECTION

PATENT NO. : 4,910,389

DATED : March 20, 1990

INVENTOR(S) : Edward S. Sherman et al

It is certified that error appears in the above-identified patent and that said Letters Patent is hereby corrected as shown below:

In Column 2, line 7, replace "cost" by --most--.

In Column 4, line 1, replace "4,14,620" by --4,514,620--.

In Column 5, line 32, after "0.8", insert --micron--.

In Column 5, line 42, replace "unooped" by --undoped--.

Signed and Sealed this

Twenty-eighth Day of May, 1991

*Attest:*

HARRY F. MANBECK, JR.

*Attesting Officer*

*Commissioner of Patents and Trademarks*